United States Patent [19]

Furrow

[11] Patent Number: 5,026,304

[45] Date of Patent: Jun. 25, 1991

[54] CONNECTOR AND CONNECTOR ASSEMBLY HAVING IMPROVED TERMINAL INSERTION FEATURE

[75] Inventor: Randy M. Furrow, Kernersville, N.C.

[73] Assignee: AMP Incorporated, Harrisburg, Pa.

[21] Appl. No.: 456,001

[22] Filed: Dec. 22, 1989

[51] Int. Cl.[5] ..... H01R 13/424; H01R 13/514

[52] U.S. Cl. ..... 439/595; 439/603; 439/686; 439/695; 439/701; 439/752

[58] Field of Search ..... 439/594, 595, 599, 603, 439/686, 689, 695, 701, 712, 744, 752

[56] References Cited

U.S. PATENT DOCUMENTS

| | | | |
|---|---|---|---|
| 3,173,734 | 3/1965 | Hartwell | 339/49 |
| 4,083,615 | 4/1978 | Volinskie | 339/17 F |
| 4,220,384 | 9/1980 | Clark et al. | 439/595 |
| 4,313,646 | 2/1982 | Millhimes et al. | 339/156 R |
| 4,601,530 | 7/1986 | Coldren et al. | 339/103 M |
| 4,690,478 | 9/1987 | Rahrig et al. | 439/595 X |
| 4,898,548 | 2/1990 | Case et al. | 439/686 |

OTHER PUBLICATIONS

AMP Special Industries bulletin 4-404845-4, "AMP Products for the office of the 80's . . . and beyond".

*Primary Examiner*—Steven C. Bishop
*Attorney, Agent, or Firm*—Eric J. Groen; Bruce J. Wolstoncroft

[57] ABSTRACT

Connector assembly comprises an outer housing and an inner housing which is inserted into the outer housing. The inner housing has terminal receiving cavities which extend between its ends and which open onto one of the sides of the inner housing along the full width thereof as measured between the ends. The terminals are inserted into the cavities by aligning the terminals with the cavities and moving them laterally of their axes into their cavities. After assembly of the terminals to the cavities, the inner housing is assembled to the outer housing.

20 Claims, 9 Drawing Sheets

2
4
14
18
16
12
38

6
70
72
86
8
20
26
34
32
36
28
24
44
22

94
74
70
14
6
88
26
10
64
66
58
68
34
30
32
40
28
56
8
36
57
20
78
42
24
48
22

CONNECTOR AND CONNECTOR ASSEMBLY HAVING IMPROVED TERMINAL INSERTION FEATURE

FIELD OF THE INVENTION

This invention relates to electrical connectors and connector assemblies of the type in which terminals are inserted into the cavities in the connector housing. The invention is particularly concerned with the manner in which the terminals are assembled to the housing.

BACKGROUND OF THE INVENTION

1. Description of the Prior Art

A commonly used type of electrical connector comprises an insulating housing having a plurality of terminal receiving cavities extending therethrough from the rearward face to the mating face. Terminals crimped onto the ends of wires are assembled to the housing by simply inserting each terminal into one of the cavities until a retaining lance on the terminal moves beyond a shoulder on the housing so that the terminal cannot be withdrawn from the connector housing.

Problems are sometimes encountered with connectors of the type described above in that the technician may fail to insert the terminal fully into the cavity in the housing so that the lance on the terminal does not move beyond the shoulder in the housing. The terminal may appear to be fully inserted and may appear to resist withdrawal, particularly, if the terminal is dimensioned such that it has a close fit in the cavity of the housing or if the insulation on the wire to which the terminal is crimped has a close fit in the housing cavity. The result is that when the connector is placed in service, that is, when it is mated with its complementary connector, the improperly inserted terminal will be pushed rearwardly from the housing and will not establish contact with a complementary terminal in the complementary connector. This problem can be partially overcome by good quality controls and careful inspection of the assembled connectors prior to their being placed in service. However, the possibility of improper insertion of the terminals into the housing cannot be completely eliminated.

Another problem which sometimes arises with connectors of the type described above results from the fact that under some circumstances, it is required that the wires to which the terminals are crimped be contained in a cable having a jacket thereon. The jacket must be removed from an end portion of the cable so that the individual wires can be spread apart and inserted into the cavities of the connector housing. It is desirable, however, to remove only a minimum amount of the cable jacket so that it will extend to a location close to the connector. The technician faced with the task of inserting the terminals on the wires into the cavities in the connector will have only a very short length of wire between the terminal and the end of the jacket to work with when the terminals are inserted. The operation of inserting the terminals into the cavity is sometimes time consuming for the reason that the technician has only a short length of flexible wire to manipulate, particularly if the wire is of a relatively heavy gauge and is relatively stiff, for example, conductors in the range of 10–12 AWG for power useage. If the cable has six or more wires therein, insertion of the first and second terminals may be accomplished with relative ease, but the insertion operation becomes increasingly awkward and difficult as the remaining terminals are inserted into the cavities for the reason that the cable is held in a fixed position by the previously inserted terminals and cannot, therefore, be manipulated by the technician in inserting the remaining terminals.

The present invention is directed to the achievement of a multi-contact electrical connector and a connector assembly having structural features which simplify the step of inserting terminals into the cavities in the connector housing and which obviate the problems discussed above.

SUMMARY OF THE INVENTION

One aspect of the invention comprises an electrical connector housing having oppositely facing first and second faces, oppositely facing first and second major side surfaces, and oppositely facing end surfaces. The side surfaces and the end surfaces extend between the first and second faces. The first face is the mating face of the housing and a plurality of terminal receiving cavities extend through the housing from the second face to the first face. Each cavity is dimensioned to receive a terminal. The housing is characterized in that each of the cavities opens onto the first side surface over the entire width of the housing as measured between the first and second faces so that a terminal can be inserted into each of the cavities by aligning the terminal with the cavity and moving the terminal laterally of its axis and into the cavity. Terminal retaining means are provided in each cavity, each retaining means comprising interengaging means in the cavity which is interengageable with a terminal positioned in the cavity. The interengaging means is resiliently deflectable by the terminal upon movement of the terminal into the cavity. In the preferred embodiment, the retaining means comprises a cantilever beam having a fixed end and a free end, the free end being proximate to the first side surface and the interengaging means is on the free end of the cantilever beam. The fixed end of the cantilever beam is proximate to the second side surface and the cantilever beam extends towards the first side surface.

In accordance with another aspect of the invention, the invention comprises an electrical connector assembly comprising a housing assembly and terminals in the housing assembly. The housing assembly comprises an inner housing and an outer housing which surrounds the inner housing. The inner housing is as described above and is inserted into the outer housing after terminals have been positioned in the cavities of the inner housing. The inner and outer housings each have a rectangular cross-section and the cavities are in a row which extends between the side surfaces of the inner housing. The outer housing comprises a hood which extends beyond the mating face which is on the inner housing and the terminals have contact blade portions which extend beyond the mating face and into the hood.

BRIEF DESCRIPTION OF THE DRAWINGS

FIG. 3 is a sectional side view showing the connector assembly with the inner housing exploded from the outer housing and with a terminal exploded from the inner housing.

FIG. 6 is a plan view of the terminal receiving side of the inner housing.

FIGS. 7, 8, and 9 are views looking in the direction of the arrows 7—7, 8—8, and 9—9 of FIG. 6.

DETAILED DESCRIPTION OF THE PREFERRED EMBODIMENT

Figure 1:
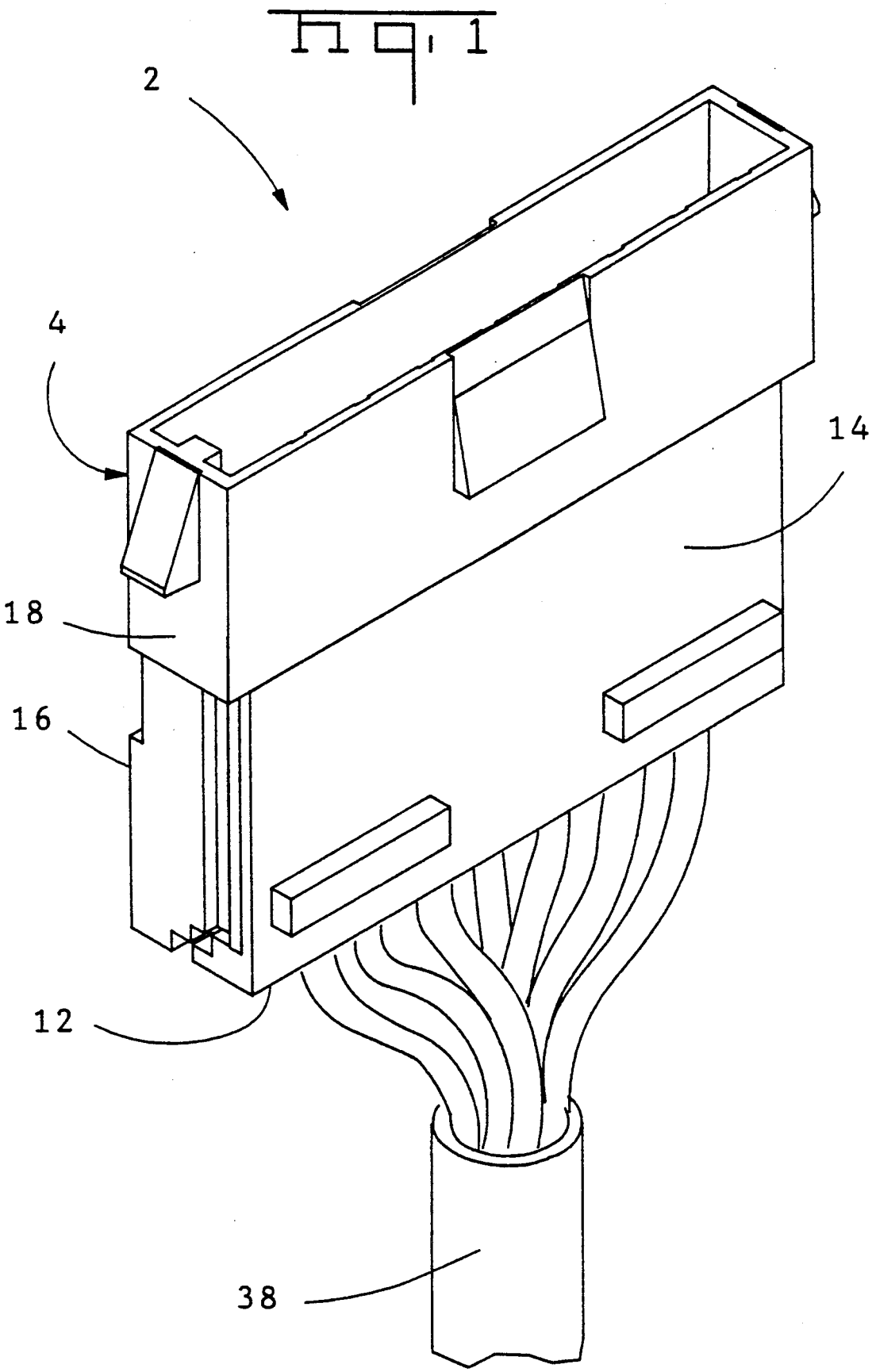
FIG. 1 is a perspective view of a connector assembly in accordance with the invention.
Figure 2:
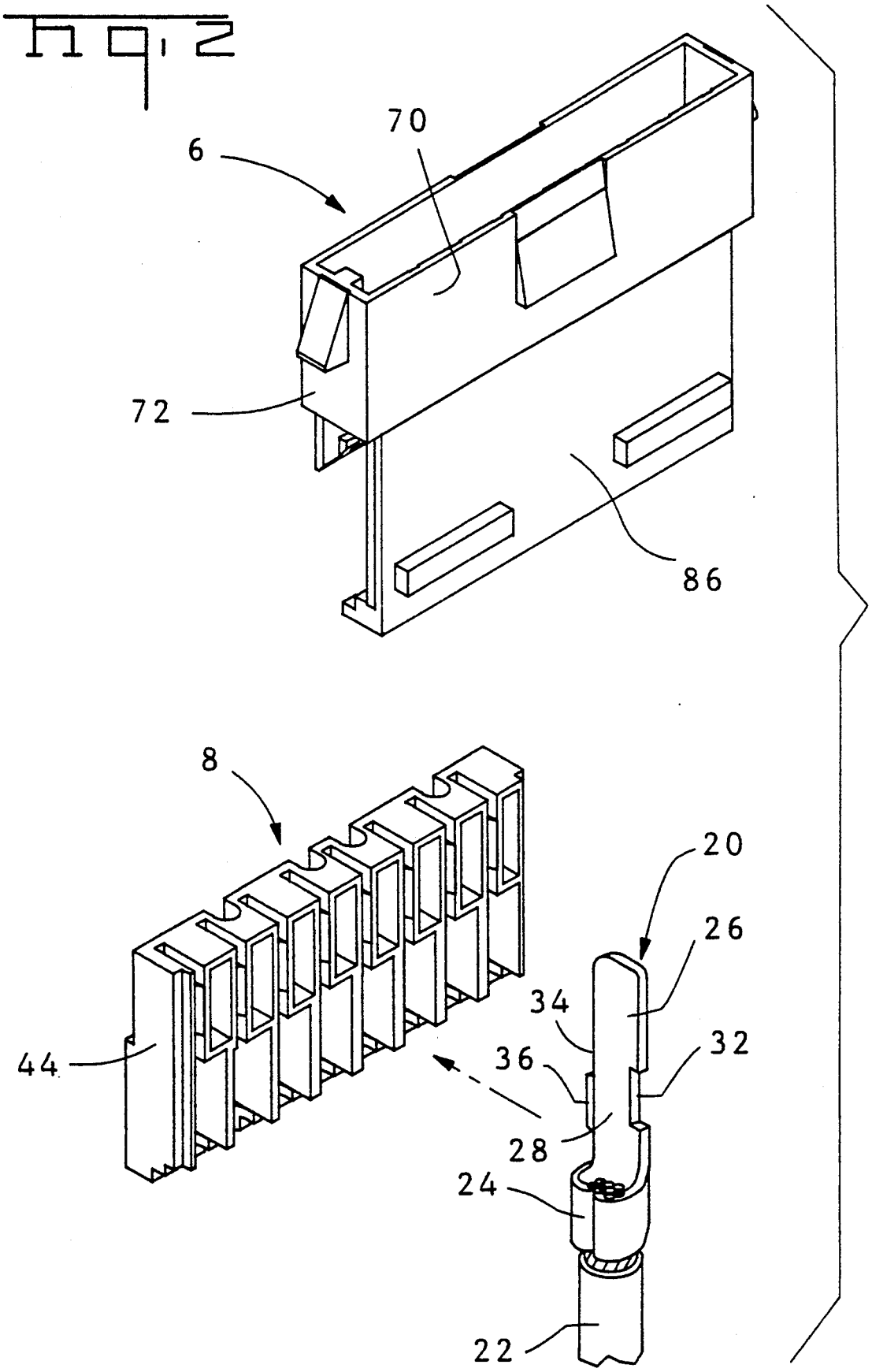
FIG. 2 is a view similar to FIG. 1, but showing the parts exploded from each other.
Figure 2:
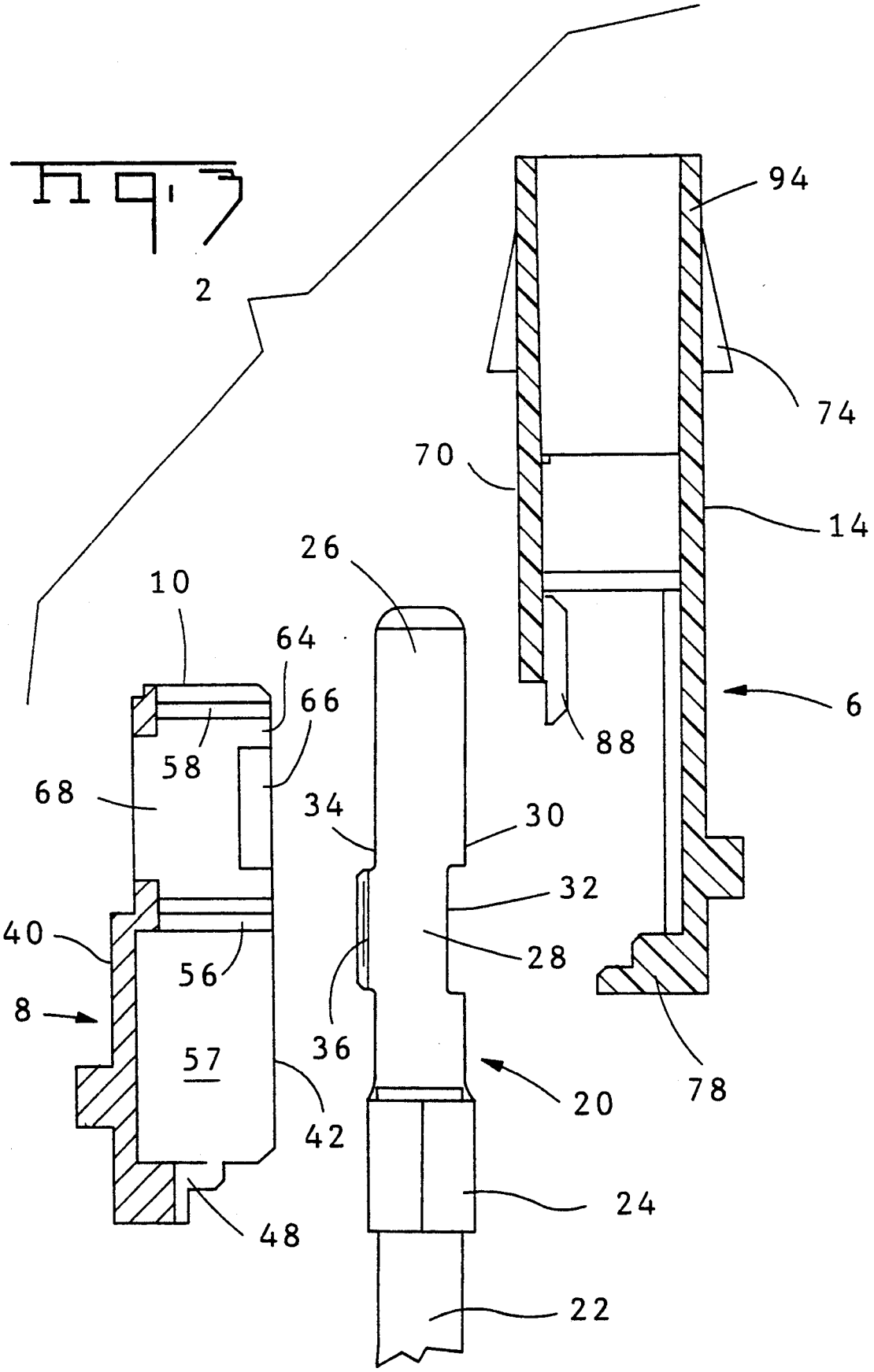

A connector assembly 2, FIGS. 1 and 2, in accordance with the invention comprises a housing assembly 4 which in turn comprises an outer housing 6, and an inner housing 8. The housing assembly has a mating face 10 (FIG. 3), a rear face 12, first and second side walls 14, 16 and oppositely facing end walls 18. The side walls and the end walls of the assembly extend continuously from the mating face to the rear face and forwardly of the mating face to provide a hood as will be described below.

Figure 6A:
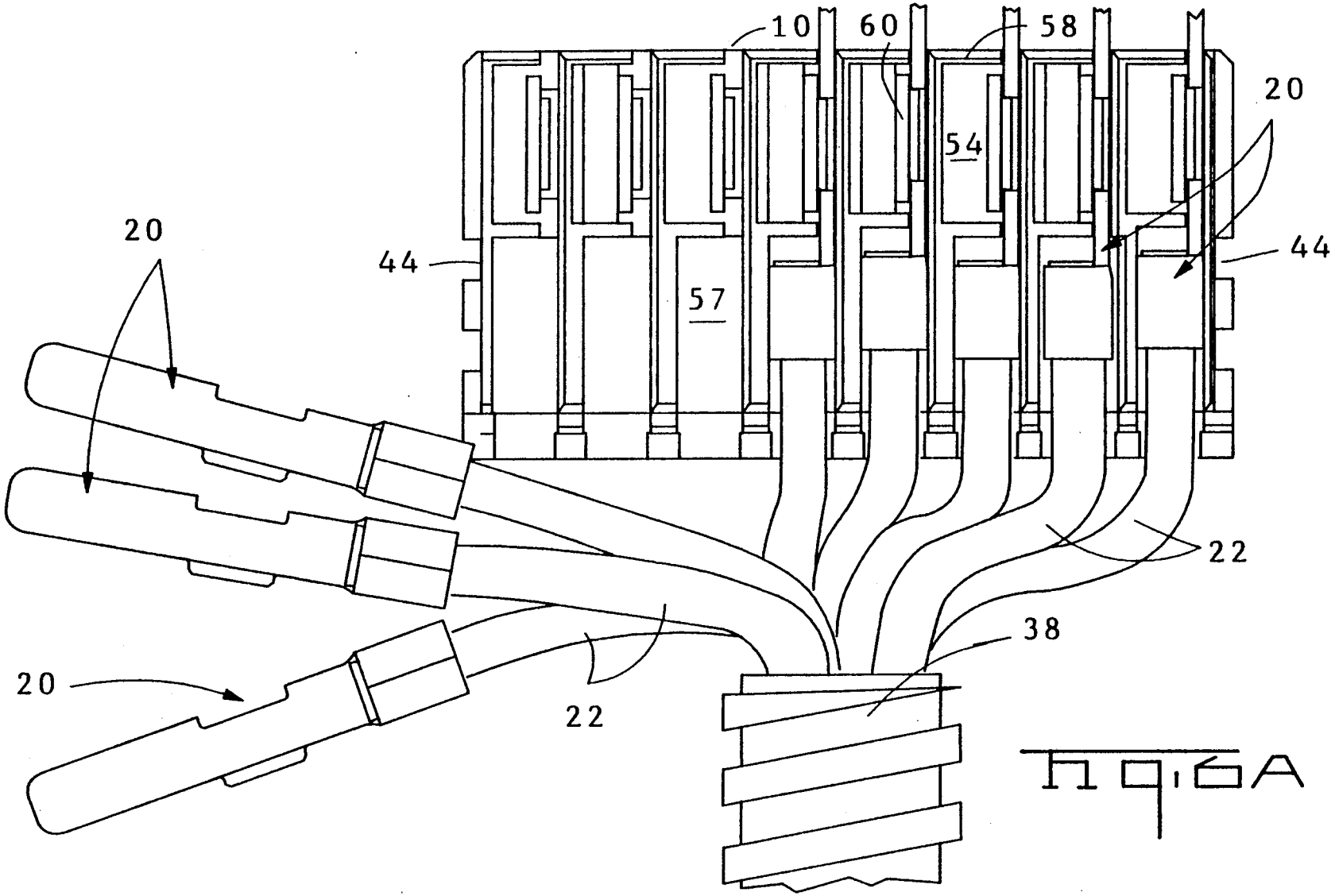
FIG. 6A is a view similar to that of FIG. 6 showing electrical terminals partially loaded in the inner housing.
Figure 7:
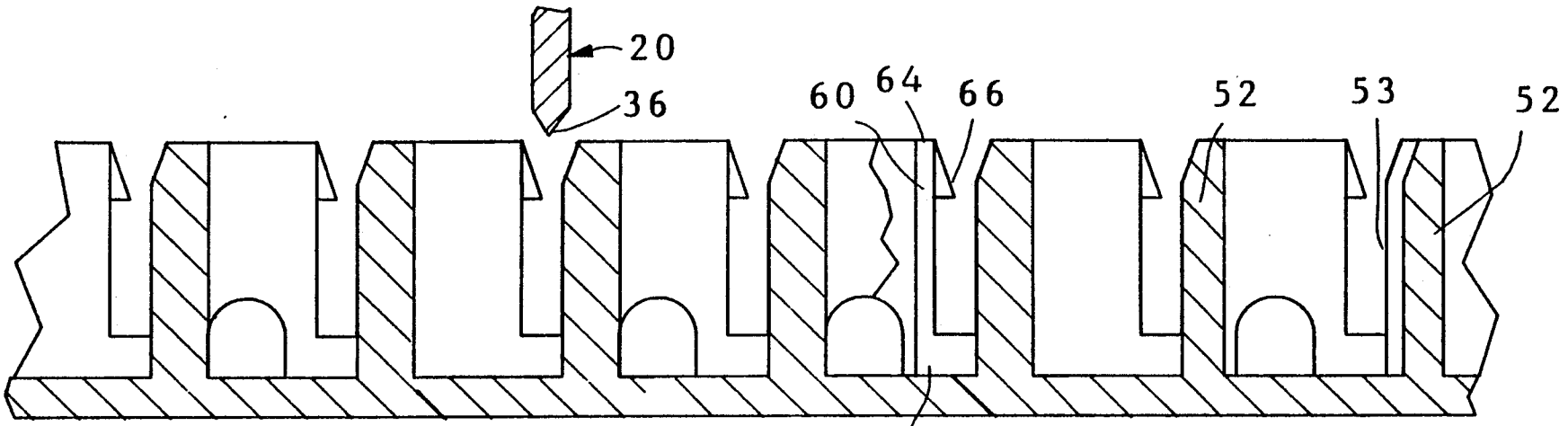

As shown in FIG. 2, the inner housing 8 contains a plurality of terminals 20 which are crimped at 24 onto conductors of insulated wires 22. Each terminal has a contact blade portion 26 and an intermediate plate-like portion 28 which is between the contact portion and the crimped portion 24. The intermediate portion 28 has one edge 30 which is notched with a shallow notch 32 and another side edge 34 which has a blade-like projection 36 extending therefrom. The individual wires are contained in a cable which is surrounded by a cable jacket 38, as shown in FIG. 6A. In the finished assembly, it is desirable that this cable jacket extend as close as possible to the rear face 12 of the housing assembly so that only a short section of each insulated wire will be exposed.

Figure 5:
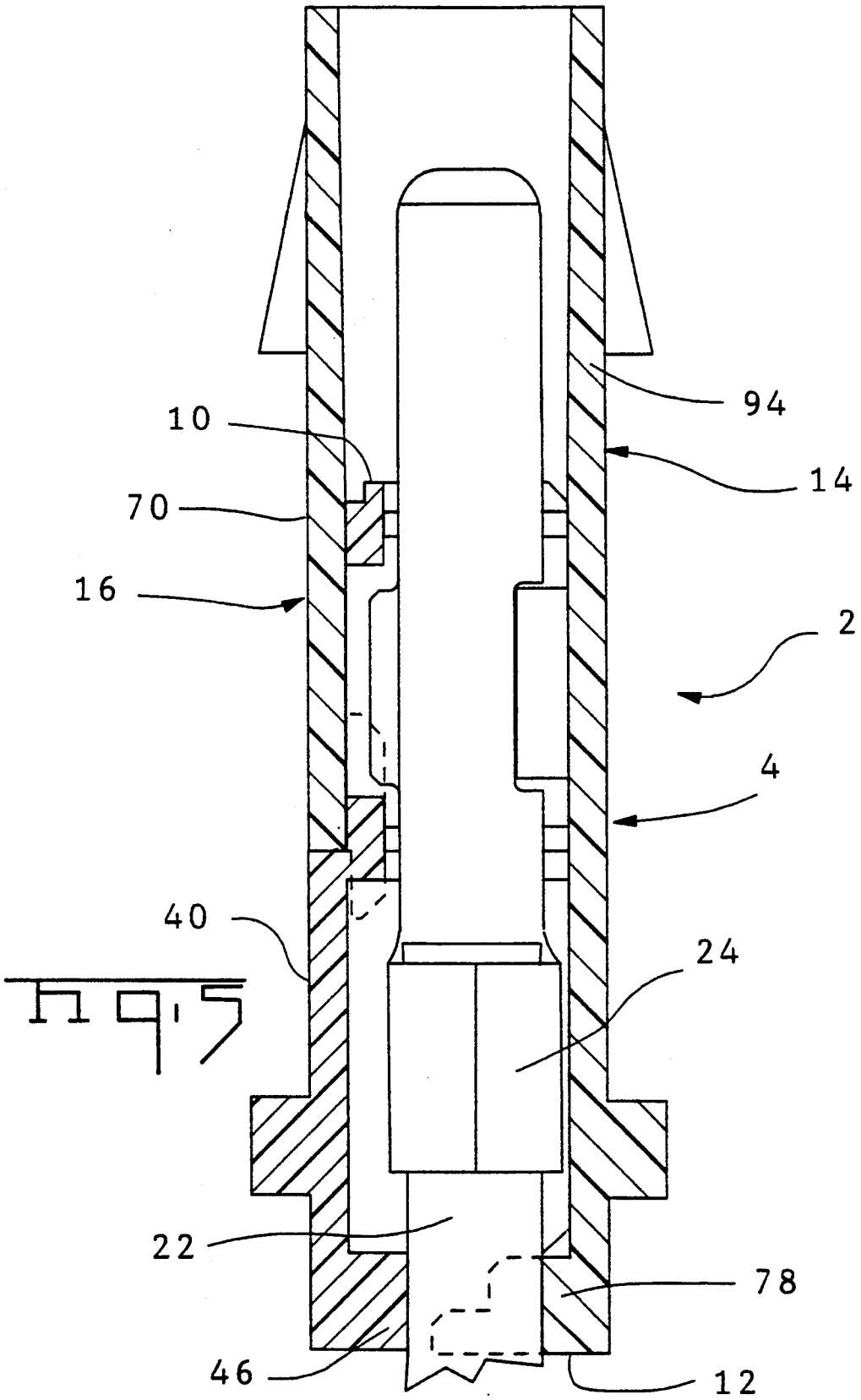
FIG. 5 is a cross-sectional view similar to that shown in FIGS. 3 and 4 showing the parts in their assembled relationships.
Figure 10:
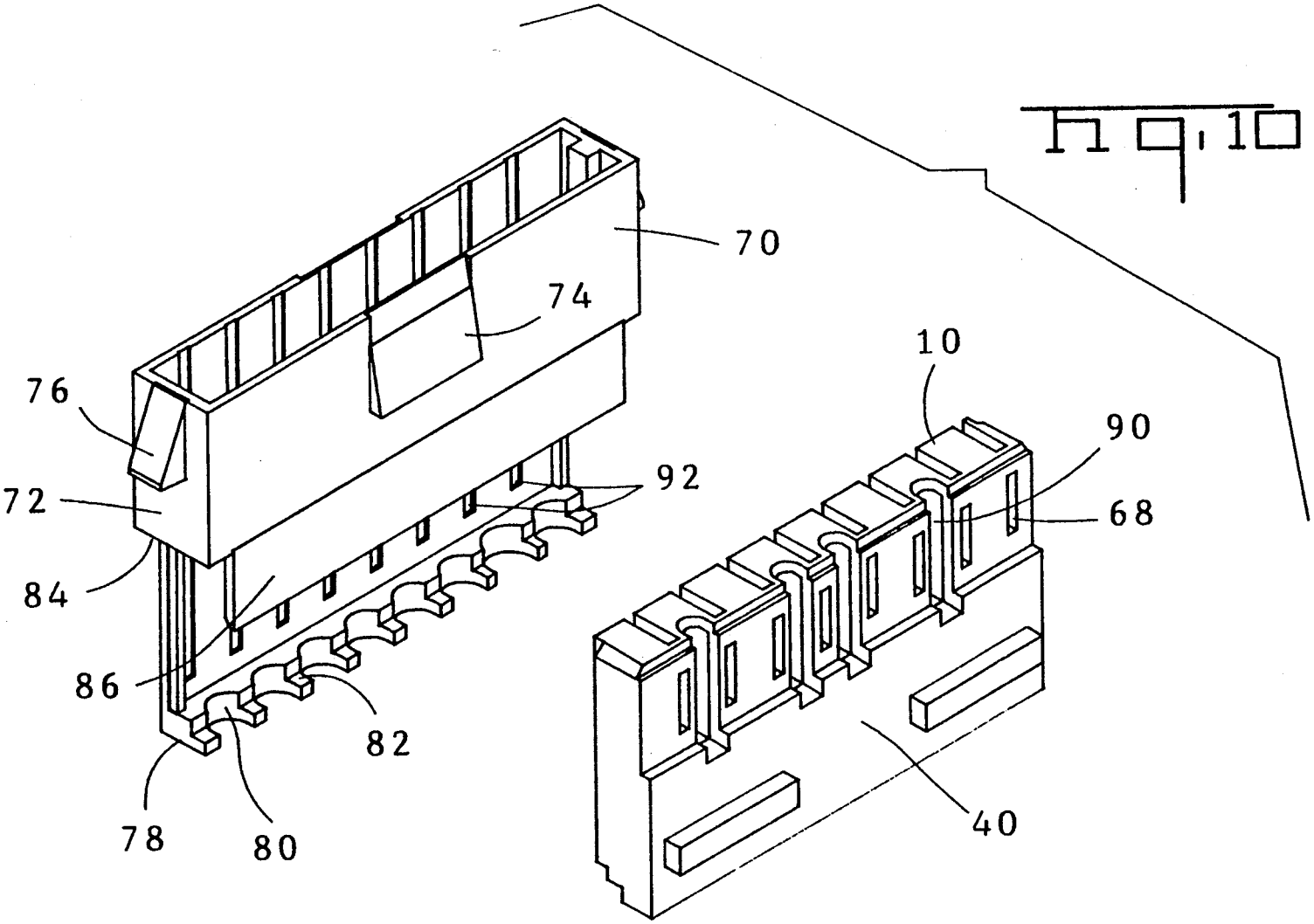
FIG. 10 is a perspective of the connector of the present invention showing the inner housing exploded from the outer housing.

The inner housing 8 has a lower surface 40, as viewed in FIG. 3, which is part of the second side wall in the connector assembly, an upper side 42, and oppositely facing end walls 44 (FIG. 2) which are part of the side walls 18 (FIG. 1) of the connector assembly 2. One end 10 of the inner housing is the mating face of the connector assembly and the opposite end of the inner housing has a lip or flange 46, as shown in FIG. 5. Spaced apart, semi-cylindrical recesses 48 (FIG. 6) are provided in the flange 46 and cooperate with similar recesses 80 (FIG. 10) in the outer housing to surround the individual wires as shown best in FIG. 5.

Figures 6, 7:
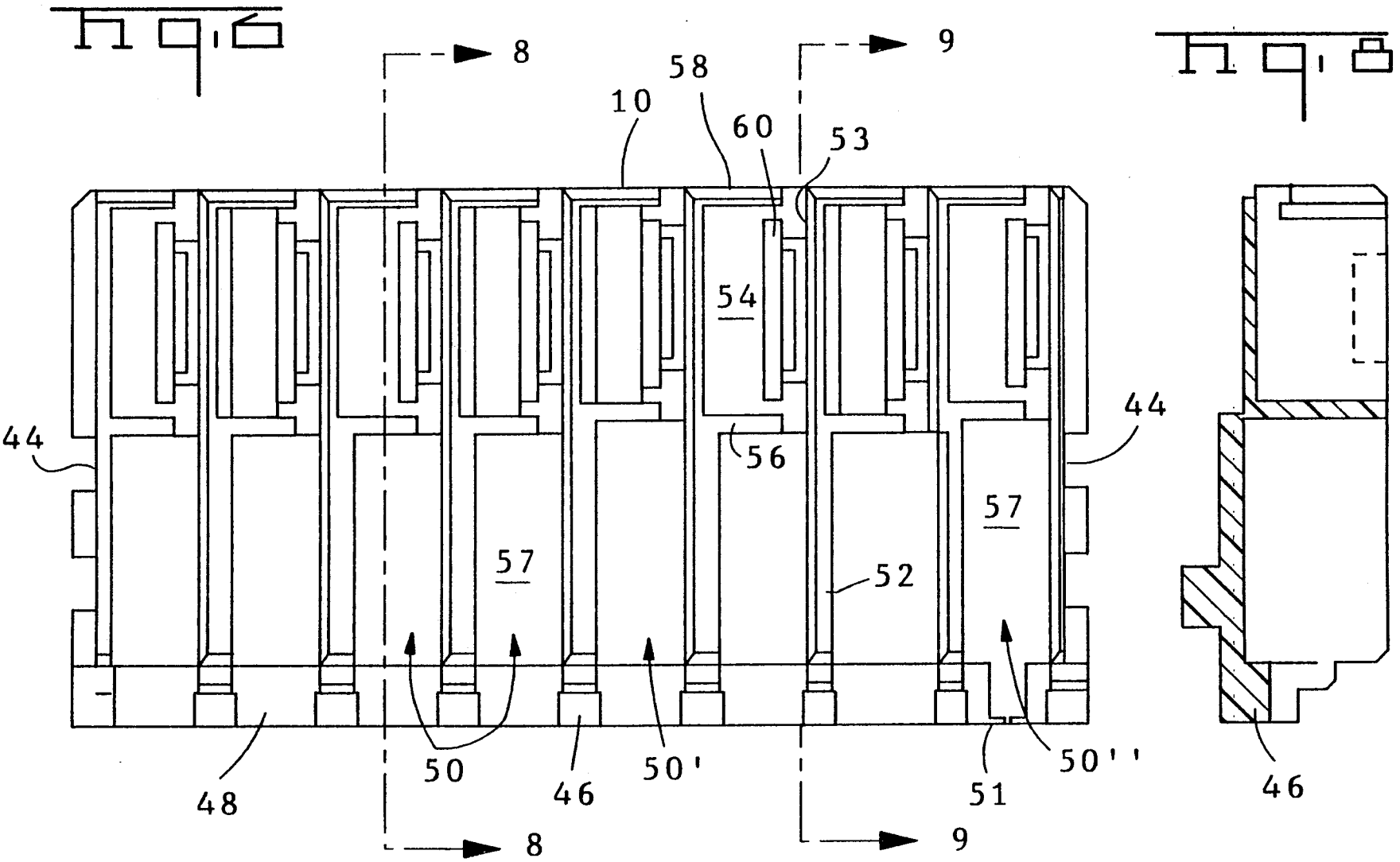

The terminal receiving cavities 50, FIGS. 6 and 7, are defined by spaced apart cavity walls 52 which extend from the flange 46 to the mating face 10. Each cavity has one portion 54 which is adjacent to, and extends rearwardly from, the mating face 10 and a rear portion 57 which extends forwardly from the flange 46. The two portions are separated from each other by a transverse wall 56 and a transverse wall 58 extends from the forward end of each wall 52 and defines the surface of the mating face 10. The transverse walls 56, 58 do not extend to the adjacent cavity wall 52 but have their ends spaced from the surface of the adjacent wall so that the terminals can be inserted into the narrow space between the ends of the transverse walls 56, 58 and the surface of the adjacent wall 52. The crimped portions of the terminals are received in the enlarged sections 57 of each cavity, as best shown in FIG. 6A.

The cavities extend inwardly from the upper side 42 of the inner housing and from the mating face 10 to the rear face so that the terminals can be inserted by aligning them with their respective cavities and moving them downwardly as suggested in FIG. 3.

Figure 9:
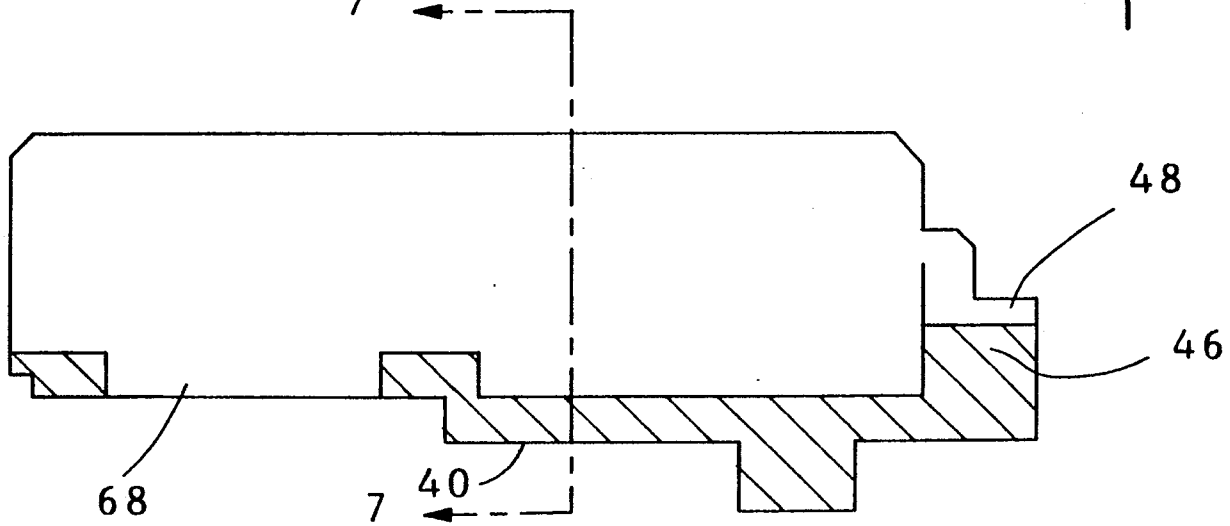

Retaining means are provided in each cavity in the form of a cantilever beam 60 (FIGS. 6A and 7) which is spaced from the surface 53 of the adjacent cavity wall 52 and which has a fixed end 62 and a free end 64. The free end of each beam is proximate to the upper side 42 and the fixed end is integral with the forward portion of the lower surface 40 which is stepped from the rearward portion of the same surface, as shown in FIG. 3. Each cantilever beam has an ear 66 on its free end which extends laterally towards the surface of the adjacent cavity wall and is sloped downwardly so that it provides a downwardly facing shoulder as viewed in FIG. 7. These ears can be flexed laterally away from the surface 53 of the adjacent cavity wall to permit insertion of the terminals and after insertion, the ears 66 will enter the notches 32 of the terminals thereby retaining the terminals in the cavities. During downward movement, the blade-like projections 36 on the edges 34 of the terminals will cam the ears and deflect them so that the terminals can move past the ears. After the terminals have been fully inserted into the cavities, the blade-like projections are received in openings 68 in the lower surface 40 as viewed in FIG. 9. The presence of these projections in the openings 68 provides a convenient inspection means so that it can be readily determined if the terminals have been properly inserted into their respective cavities. The opening 68 is formed when the inner housing is produced by injection molding by a core pin which extends through the cavity and forms the downwardly facing shoulder on the projecting ear.

The first side wall of the connector assembly 14 is one of the side walls of the outer housing and the other side wall 70 of the outer housing forms part of the second side wall 16 of the connector assembly as shown in FIG. 5. The outer housing has end walls 72 which extend partially rearwardly past the mating face and have ends 84 which adjoin the end walls of the inner housing in the completed assembly to form the end walls of the completed assembly. Conventional latch ears 74, 76 are provided on the outer housing end walls and side walls for cooperation with latch arms on a complementary connecting device. A flange or lip 78 extends from the rearward end of the side wall 14 and complements the flange 46 on the inner housing. This flange has spaced apart semi-cylindrical recesses 80 and both of the flanges are stepped as shown at 82 so that when the parts are assembled to each other, the edges of the flanges will fit closely together and surround the wires.

A ledge or extension 86 projects from the outer housing side wall 70 beyond the ends 84 of the end walls 72 and this extension has teeth or keys 88 integral with its internal surface. These keys are received in spaced apart slots 90 in the inner housing which extend rearwardly from the mating face thereof. The keys and keyways provide an immediate visual indication or aligning means to facilitate insertion of the inner housing into the outer housing. Additional aligning means are provided in the form of shallow grooves 92 which extend forwardly from a location adjacent to the lip 78 towards the forward end of the outer housing. These grooves are dimensioned to receive the ends of the contact portions 26 of the contact terminals.

Figure 4:
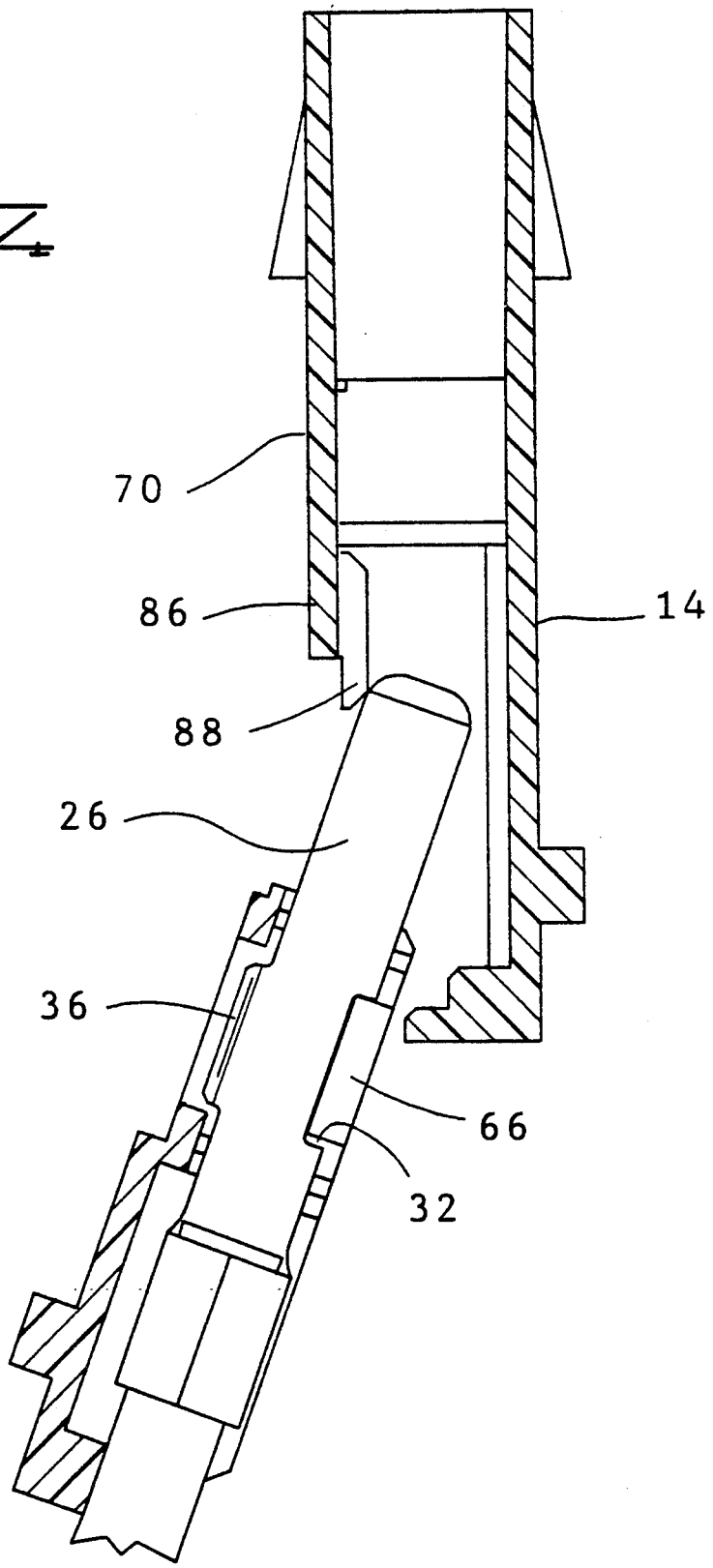
FIG. 4 is a view similar to FIG. 3 but showing the terminal assembled to the inner housing and illustrating the manner in which the inner housing is inserted into the outer housing.

The steps which are followed to assemble the connector assembly are as follows. The individual terminals on the ends of the wires 22 are first aligned with the cavities in the inner housing as shown in FIG. 3 and are moved downwardly into their respective cavities. During such movement, the blade-like projection 36 of each terminal will flex the associated cantilever beam and permit movement of the terminal into the cavity. The terminals are inserted into the cavities one at a time and since there is only a short length of insulated wire 22 between each terminal and the end of the cable jacket, the technician has only a limited amount of slack wire to permit manipulation of the terminals. However, since the terminals are inserted laterally of their axis, the fact that there is only a short length of wire available is not an inconvenience. After the terminals have been placed in the cavities in the inner housing, the inner housing is aligned with the outer housing as shown in FIG. 4 with the axis of the inner housing inclined with respect to the axis of the outer housing. The ends of the terminals are positioned in the grooves or slots 92 and the inner housing is pushed forwardly until the teeth 88 enter the aligning slots 90. The inner housing is then forced past the lip 78 and some flexure takes place in the side wall 40. After the terminals have moved forwardly to a location beyond the mating face, the lip 78 returns to its normal position and the wires are completely surrounded by the lips 78 and partially sealed. In the finished assembly, the forward portion of the outer housing 94 functions as a hood which extends beyond the mating face 10 and which surrounds the contact portions of the terminals.

Connector assemblies in accordance with the invention avoid the problems of inserting terminals into cavities, as explained above, when the jacket of a cable containing the wires must extend close to the rearward end of the connector. If the terminals are inserted axially in the conventional manner, the technician has considerable difficulty inserting the wires because of the very short length of free wire 22 between the terminal and the end of the jacket material. Since the terminals are inserted laterally of their axes, however, they need not be manipulated to a high degree during the terminal insertion operation.

The completed connector assembly is relatively compact and its dimensions need be no greater than a similar connector of convention design; that is, a connector of the type in which the terminals are inserted axially from the rearward face of the connector housing. In fact, the connector assembly shown in the drawing has precisely the same dimensions as a convention connector which it replaces and is interchangeable with the previously existing conventional connector.

Under some circumstances, the inner housing 8 might, itself, serve as a connector housing since the terminals are securely retained in their respective cavities by the cantilever beams and by the transverse barrier walls 56 which function as stops for the crimp portions of the terminals as shown in the drawing. The terminals need not necessarily be blade-type terminals as shown, but could be, alternatively, contact sockets appropriately dimensioned for the housing.

Both the inner housing and the outer housing can be produced by injection molding processes involving only "straight draw" molds. Inspection of the housings will show that if the parting line of the molds in which they are produced is between the sides 14 and 70 of the outer housing or the sides 40 and 42 of the inner housing, all of the core pins required can extend normally of these sides of the inner and outer housings. It is a distinct advantage in molding operations if a part can be made with a straight draw mold rather than a mold which requires core pins that extend parallel to the parting line and laterally of the direction of movement of the mold parts towards and away from each between their opened and closed positions. The latter molding technique requires an extremely complicated mold which contains mechanism which will move the core pins into the mold cavity after the mold parts are closed and withdraw the core pins before the mold parts are open. With a straight draw mold, on the other hand, the core pins can be fixed to the two mold parts and withdrawn from the cavity when the mold is opened since the core pins do not extend laterally of any of the portions of the molded article.

As shown in FIG. 6, the cavities 50' and 50'' differ from the other cavities in that the barrier walls 56 of these cavities are displaced towards the mating face 10 by a slight distance. The cavity 50' is intended to receive a terminal on an isolated ground wire and the cavity 50'' is intended for a common ground. The terminals in these cavities will therefore "make first and break last" so that the ground circuits will be established before power circuits, or other active circuits, are established and these ground circuits will be maintained until after the other circuits are broken when the connector is coupled to, and disengaged from, a complementary connector.

The cavity 50'' differs from the other cavities in that a thin membrane-like wall 51 is provided at the entrance. Common ground wires are ordinarily uninsulated and may have a smaller diameter than the insulated wires in the connector. When the terminal on the common ground is inserted into cavity 50'', this membrane 51 would be broken.

The recesses 48 can serve as a strain relief means if they are dimensioned such that the insulation on the wires is tightly gripped by the surfaces of the recesses. Also, if a post molding operation is performed on the connector after assembly thereof, the recesses will prevent the flow of molding material into the cavities. The flow of molding material into the cavity 50'' will be prevented by the membrane 51.

An additional advantage realized by the practice of the invention lies in the fact that the intermediate portion 28 of the terminal 20 is a simple flat stamped plate-like portion and the retaining means on this portion is a notch 32 in one of the edges. The requirement of an obliquely extending retaining lance, as is common in conventional terminals, is avoided. Such lances require a forming step during manufacture of the terminal and are susceptible to damage during handling prior to insertion of the terminal into the cavity.

The integrally molded cantilever beam 60 of the invention can be used under a variety of circumstances other than those described above; for example, in a conventional connector housing into which the terminals are inserted axially from the rear face towards the mating face. Under such circumstances, the beam would extend parallel to the direction of terminal insertion and towards the mating face or the rear face.

I claim:

1. An electrical connector assembly comprising a housing assembly and contact terminals in the housing assembly, the housing assembly having a mating face and a rear face, first and second sidewalls extend from the mating face to the rear face, a plurality of cavities extending through the housing assembly from the rear face to the mating face, the terminals being in the cavities, the connector assembly being characterized in that:

the housing assembly comprises an inner housing and an outer housing which surrounds the inner housing when the inner and outer housings are assembled to each other, the cavities extending through the inner housing, the inner housing has a terminal receiving surface which extends from the mating face to the rear face, a plurality of terminal receiving openings extend into the terminal receiving surface, each of the openings extend into the terminal receiving surface, each of the openings extending from the mating face to the rear face and communicating with one of the cavities, terminal retaining means are provided in each of the cavities, and the inner housing is insertible into the outer housing after insertion of terminals into the cavities, the outer housing having wall portions which are in covering relationship to the openings after insertion of the inner housing into the outer housing, a first portion of the second sidewall is part of the inner housing whereby, terminals can be inserted into the cavities by movement of the terminals laterally of their axes and into the cavities, and the inner housing can thereafter by inserted into the outer housing to complete the connector assembly.

2. A connector assembly as set forth in claim 1 characterized in that the first sidewall is part of the outer housing and constitutes the wall portions of the outer housing which are in covering relationship to the openings in the inner housing when the inner and outer housings are in assembled relationship.

3. A connector assembly as set forth in claim 2 characterized in that a second portion of the second sidewall is on the outer housing and extends from the mating face towards the rear face to an intermediate location, and the first portion of the second sidewall is on the inner housing and extends from the intermediate location to the rear face.

4. A connector assembly as set forth in claim 3 characterized in that the outer housing has a hood portion which extends forwardly beyond, and surrounds, the mating face.

5. A connector assembly as set forth in claim 1 characterized in that the terminal retaining means comprises interengaging means in each cavity which is interengageable with a terminal positioned in the cavity.

6. A connector assembly as set forth in claim 5 characterized in that the interengaging means in each cavity comprises a cantilever beam which has a fixed end and a free end, the free end being proximate to the first sidewall, the interengaging means being on the free end of the cantilever beam.

7. A connector assembly as set forth in claim 6 characterized in that the fixed end of the cantilever beam is proximate to the second sidewall and the cantilever beam extends from its fixed end towards the first sidewall.

8. A connector assembly as set forth in claim 7 characterized in that each cavity has an internal cavity wall which is beside, and opposed to, the cantilever beam, the interengaging means comprising a retaining ear on the cantilever beam proximate to its free end, the ear extending laterally towards the internal cavity wall and being engageable by the terminal during movement of the terminal into the cavity thereby to deflect the beam away from the cavity wall and permit movement of the terminal into the cavity.

9. A connector assembly as set forth in claim 8 characterized in that each terminal has a flat plate-like section which is parallel to its associated internal cavity wall and is between the cavity wall and the cantilever beam when the terminal is in the cavity, the plate-like section having side edges, one of the side edges having a notch therein, the retaining ear being received in the notch when the terminal is positioned in the cavity.

10. A connector assembly as set forth in claim 9 characterized in that the other edge of the plate-like section has a blade-like projection thereon which engages the retaining ear during movement of the terminal into the cavity and deflects the cantilever beam.

11. A connector assembly as set forth in claim 3 characterized in that the first and second sidewalls have first and second flanges thereon at the rear face of the assembly, the flanges extending towards each other, the flanges having spaced apart substantially semi-circular recesses in their meeting edges which surround wires which extend from terminals contained in the cavities.

12. An electrical connector having a housing with oppositely facing first and second faces oppositely facing first and second major side surfaces, and oppositely facing end surfaces, the side surfaces and the end surfaces extending between the first and second faces, the first face being the mating face of the housing, the housing having a plurality of side-by-side terminal receiving cavities therein, each cavity extending from the second face to the first face and being dimensioned to receive a terminal, the connector being characterized in that:

each of the cavities opens onto the first side surface over the entire width of the housing as measured between the first and second faces whereby a terminal can be inserted into each of the cavities by aligning the terminal with the cavity and moving the terminal laterally of its axis and into the cavity, and terminal retaining means are provided in each cavity, each retaining means comprising interengaging means in the cavity which is interengageable with a terminal positioned in the cavity, the terminal has a blade-like camming ear thereon which is engageable with the retaining means to flex the retaining means during initial movement of the terminal into the cavity whereby, the interengaging means is deflected during movement of a terminal into the cavity and after the terminal has been inserted into the cavity, the interengaging means returns to its normal position and prevents lateral and axial movement of the terminal from the cavity.

13. A connector housing as set forth in claim 12 characterized in that the retaining means in each cavity comprises a cantilever beam having a fixed end and a free end, the free end being proximate to the first side surface, the interengaging means being on the free end of the cantilever beam.

14. A connector housing as set forth in claim 13 characterized in that the fixed end of the cantilever beam is proximate to the second side surface and the cantilever beam extends towards the first side surface.

15. A connector housing as set forth in claim 14 characterized in that each cavity has a cavity wall which is beside, and opposed to, the cantilever beam, the interengaging means comprising a retaining ear on the cantilever beam proximate to its free end, the retaining ear extending laterally towards the wall and being engageable by the terminal during movement of the terminal into the cavity thereby to deflect the beam away from the wall and permit movement of the terminal into the cavity.

16. A connector housing as set forth in claim 15 characterized in that the retaining ear is dimensioned to be received in a recess in the terminal whereby after the terminal has been moved into the cavity, the beam returns to its normal undeflected position and the retaining ear enters the recess in the terminal.

17. A connector housing as set forth in claim 16 characterized in that the retaining ear has a camming surface which is inclined from the free end towards the fixed end and is inclined laterally towards the cavity wall, the camming surface being engageable by the terminal upon movement of the terminal into the cavity.

18. A connector housing as set forth in claim 17 characterized in that the housing is the inner housing part of a housing assembly, the housing assembly comprising the inner housing and an outer housing, the inner housing being insertible into the outer housing after terminals have been inserted into the inner housing.

19. A molded plastic electrical connector having a housing with a terminal receiving cavity extending therethrough from the rear face to the mating face thereof, terminal retaining means in the cavity for retaining a terminal therein after insertion of the terminal into the cavity, the connector housing being characterized in that:

a cantilever beam is provided in the cavity which has a fixed end and a free end, the beam being a molded integral part of the housing and extending from its fixed end, the beam extending substantially normally of the axis of the cavity, a retaining ear is provided on the free end which extends laterally into the cavity from one side of the cavity, the ear being dimensioned for reception in a recess in a terminal after insertion of the terminal into the cavity, the ear having camming surface portions which are engageable by the terminal during movement of the terminal into the cavity to cause flexure of the cantilever beam, the terminal having a flat plate-like portion in which the recess is located, the recess comprising a notch in one edge of the plate-like portion whereby, during insertion of the terminal into the cavity, the terminal flexes the beam in a lateral direction away from the path of movement of the terminal and when insertion is completed, the beam returns to its normal position and the retaining ear enters the recess in the terminal thereby retaining the terminal in the cavity.

20. A connector housing as set forth in claim 19 characterized in that the housing has oppositely facing side surfaces which extend between the mating face and the rear face, a terminal-receiving opening is provided in the first side surface which communicates with the cavity whereby the terminal is inserted into the cavity by aligning the terminal with the opening and moving the terminal laterally of its axis and into the cavity, the fixed end of the beam being proximate to the second side surface, the beam extending towards the first side surface, the free end being proximate to the first side surface.

* * * * *